US008308251B2

(12) United States Patent
Liang et al.

(10) Patent No.: US 8,308,251 B2
(45) Date of Patent: Nov. 13, 2012

(54) ELASTIC FORCE ADJUSTMENT DEVICE FOR SLIDE ASSEMBLY

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 238 days.

(21) Appl. No.: 12/783,864

(22) Filed: May 20, 2010

(65) Prior Publication Data

US 2011/0286689 A1 Nov. 24, 2011

(51) Int. Cl.
*A47B 88/04* (2006.01)

(52) U.S. Cl. ..... 312/333; 312/319.1

(58) Field of Classification Search ..... 312/319.1, 312/333, 330.1, 334.6, 334.7, 334.8, 334.1, 312/334.44, 334.46
See application file for complete search history.

(56) References Cited

U.S. PATENT DOCUMENTS

| | | | | |
|---|---|---|---|---|
| 5,474,375 | A * | 12/1995 | Hollenstein et al. | 312/319.1 |
| 6,736,471 | B2 * | 5/2004 | Lin | 312/333 |
| 6,846,053 | B2 * | 1/2005 | Salice | 312/334.14 |
| 6,848,759 | B2 * | 2/2005 | Doornbos et al. | 312/319.1 |
| 7,374,260 | B2 * | 5/2008 | Lu | 312/333 |
| 7,465,000 | B2 * | 12/2008 | Huang | 312/333 |
| 2007/0046158 | A1 * | 3/2007 | Hoffman | 312/333 |
| 2007/0132346 | A1 * | 6/2007 | Huang | 312/333 |
| 2007/0186481 | A1 * | 8/2007 | Tomita et al. | 49/409 |
| 2007/0278917 | A1 * | 12/2007 | Yang | 312/330.1 |
| 2009/0115300 | A1 * | 5/2009 | Chen et al. | 312/334.1 |
| 2011/0042446 | A1 * | 2/2011 | Liang et al. | 228/196 |

FOREIGN PATENT DOCUMENTS

WO WO2006-066774 * 6/2006

* cited by examiner

*Primary Examiner* — James O Hansen
*Assistant Examiner* — Matthew Ing
(74) *Attorney, Agent, or Firm* — Rosenberg, Klein & Lee

(57) ABSTRACT

An elastic force adjustment device for slide assembly includes a fixing member, a movable member, an adjustment member and at least one elastic member. The fixing member includes a threaded rod and a longitudinal body. A longitudinal guiding portion is located between two ends of the longitudinal body. The adjustment frame has a mounting portion connected to the threaded rod. The adjustment member contacts the adjustment frame and has a threaded portion threadedly connected to the threaded rod. The at least one elastic member has two ends which are respectively connected to the movable member and the adjustment frame. A force of the at least one elastic member or the position of the movable member is adjusted by rotating the adjustment member on the threaded rod.

7 Claims, 5 Drawing Sheets

ELASTIC FORCE ADJUSTMENT DEVICE FOR SLIDE ASSEMBLY

FIELD OF THE INVENTION

The present invention relates to an elastic force adjustment device, and more particularly, to an elastic force adjustment device for adjusting the elastic force to control the distance that the rails travel in response to the load of the rails.

BACKGROUND OF THE INVENTION

U.S. Pat. No. 7,374,261 discloses a push-open type slide structure comprises a top fastener and a locking device between an outer slide rail and a pull rod. The loading plate is extended from one side of the center portion of the main body. Two pillars are extended from both sides of the main body. A positioning fastener is coupled with the loading plate. A hook is mounted on the inner edge of the loading plate. A guide pillar is mounted on the rear end of the loading plate. The hook is inserted into the action trench of the main body and coupled with the elastic device. The locking device has a connection part for coupling with a guide part and a shaft holder. The push-open type slide structure is lockable or unlockable by pivotal rotation between the loading plate and the locking device. As a result, the push-open type slide structure can be controlled easily.

The push-open type slide structure is operated by the stored force of the elastic device and the specification of the elastic device is chosen so as to have a fixed elastic force. When in use, the slide assembly is connected between the furniture part and the drawer so that when the drawer is pushed inward, the drawer opens automatically from the furniture part. However, when the drawer has different loads, especially heavy objects, the load on the drawer applied to the rails cannot make the drawer to be opened to a desired position. Furthermore, when the furniture include multiple drawers and different loads are received in the drawers, the drawers open to different positions which may be confused to the users.

The inventor develops an elastic force adjustment device for the push-open type slide assembly so as to improve the shortcomings of the conventional push-open type slide assembly.

SUMMARY OF THE INVENTION

The present invention intends to provide an elastic force adjustment device for the push-open type slide assembly, and the adjustment device adjusts the stored elastic force to adjust the travel distance of the rails.

The present invention relates to an elastic force adjustment device for slide assembly which includes a first rail and a second rail slidably connected to the first rail. The elastic force adjustment device comprises a fixing member fixedly connected to the first rail and including a threaded rod and a longitudinal body. The longitudinal body has a first end and a second end which is located in opposite to the first end. A longitudinal guiding portion is located between the first and second ends. A movable member is slidably connected to the longitudinal guiding portion of the fixing member. An adjustment frame has a mounting portion connected to the threaded rod of the fixing member. An adjustment member has a threaded portion threadedly connected to the threaded rod of the fixing member. The adjustment member contacts the adjustment frame. At least one elastic member has two ends which are respectively connected to the movable member and the adjustment frame. A force of the at least one elastic member or the position of the movable member is adjusted by rotating the adjustment member on the threaded rod of the fixing member.

The fixing member has a stop located between the first and second ends thereof. The movable member is movable between the second end of the fixing member and the stop.

A buffering coat is mounted to the stop.

The second rail includes a push member located corresponding to the movable member.

The adjustment frame includes an urging member and the adjustment member is located and in contact between the urging member and the mounting portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
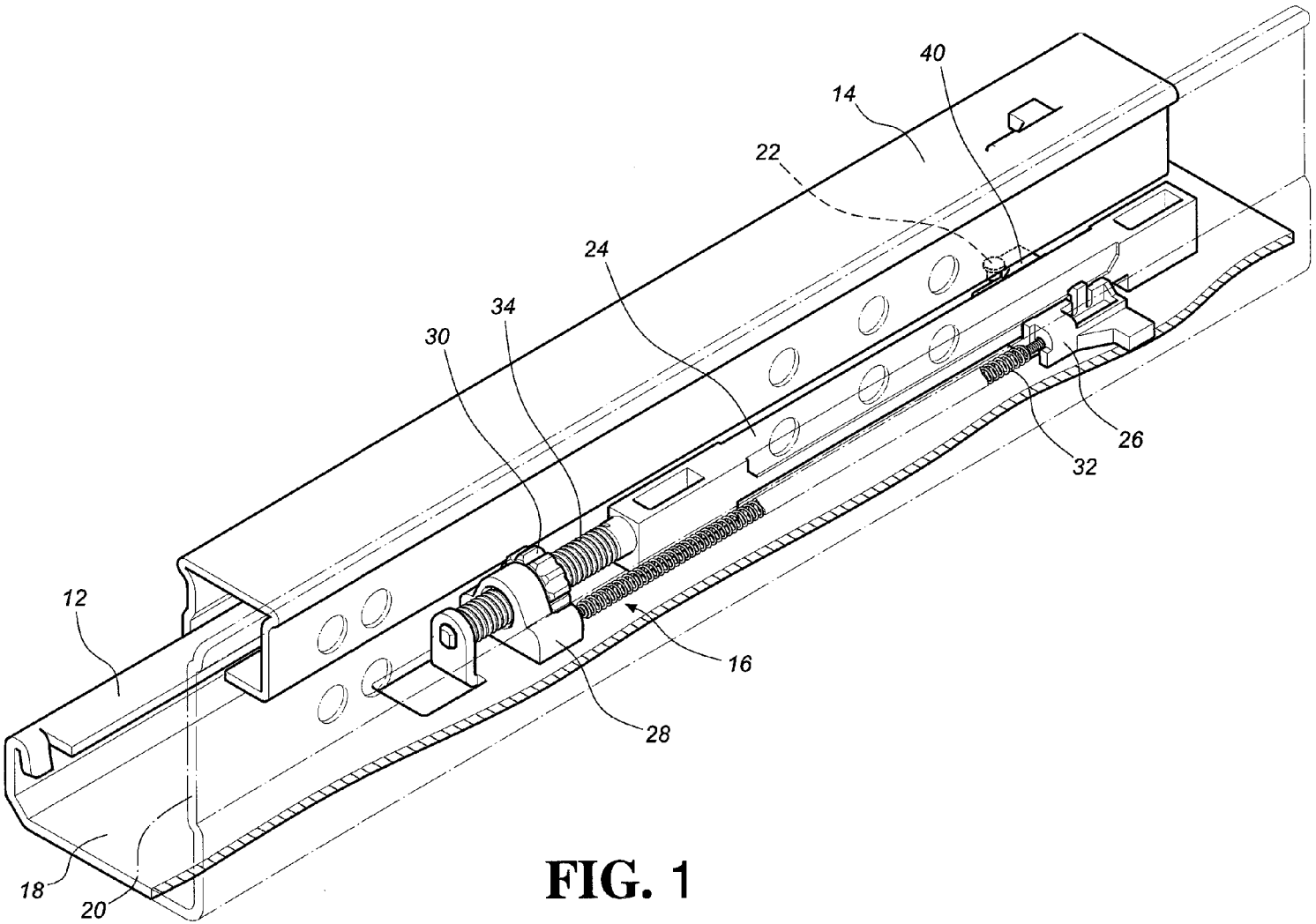
FIG. 1 is a perspective view to show the elastic force adjustment device of the present invention is installed to the slide assembly.
Figure 2:
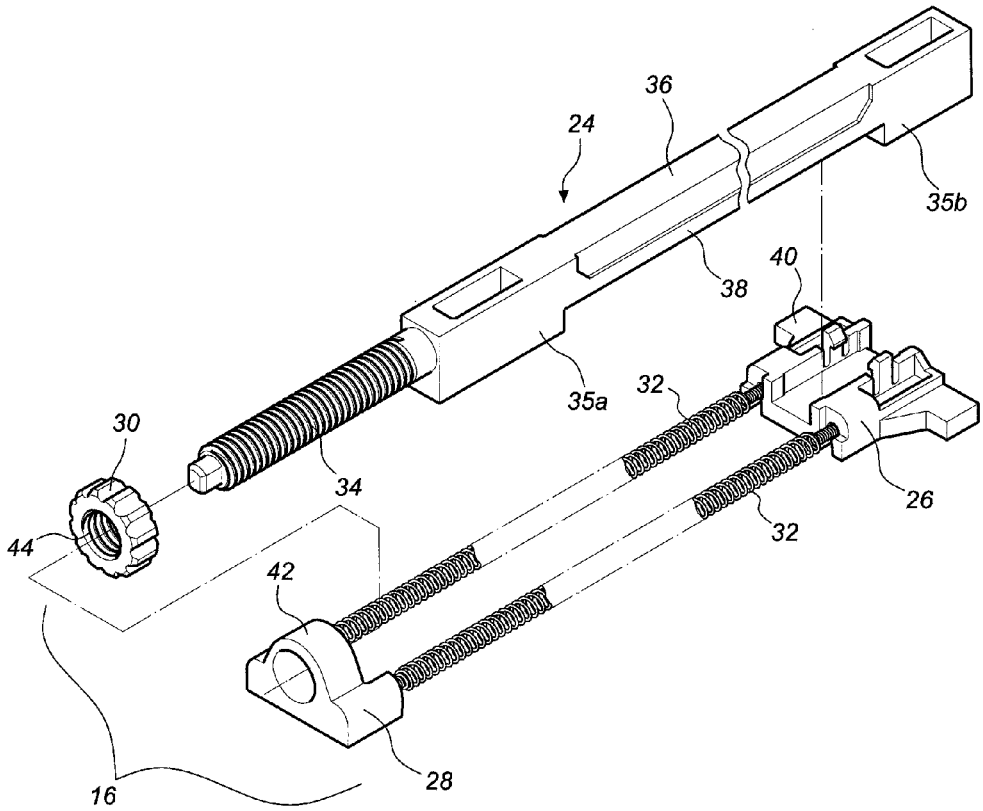
FIG. 2 is an exploded view to show the elastic force adjustment device of the present invention.

Referring to FIGS. 1 and 2, the slide assembly comprises a first rail 12 and a second rail 14 which is slidably and longitudinally connected to the first rail 12. An elastic force adjustment device 16 of the present invention is installed to the first rail 12 so as to provide an adjustable and elastic force to the second rail 14 which is opened relative to the first rail 12.

The first rail 12 includes a bottom board 18 and a sidewall 20 which extends perpendicularly from the bottom board 18.

The second rail 14 includes a push member 22.

The elastic force adjustment device 16 comprises a fixing member 24, a movable member 26, an adjustment frame 28, an adjustment member 30 and at least one elastic member 32, wherein the fixing member 24 is fixedly connected to the first rail 12 and includes a threaded rod 34 and a longitudinal body 36. The longitudinal body 36 has a first end 35*a* and a second end 35*b* which is located in opposite to the first end 35*a*. A longitudinal guiding portion 38 is located between the first and second ends 35*a*, 35*b*.

The movable member 26 is slidably connected to the longitudinal guiding portion 38 of the fixing member 24 and movable along the longitudinal guiding portion 38. The movable member 26 includes a contact portion 40 which is located corresponding to the push member 22 of the second rail 14 so that the movable member 26 is moved with the movement of the push member 22 of the second rail 14 by the contact portion 40.

The adjustment frame 28 has a mounting portion 42 connected to the threaded rod 34 of the fixing member 24.

The adjustment member 30 has a threaded portion 44 threadedly connected to the threaded rod 34 of the fixing member 24.

The at least one elastic member 32 (or two elastic members 32) has two ends which are respectively connected to the movable member 26 and the adjustment frame 28.

Figure 3:
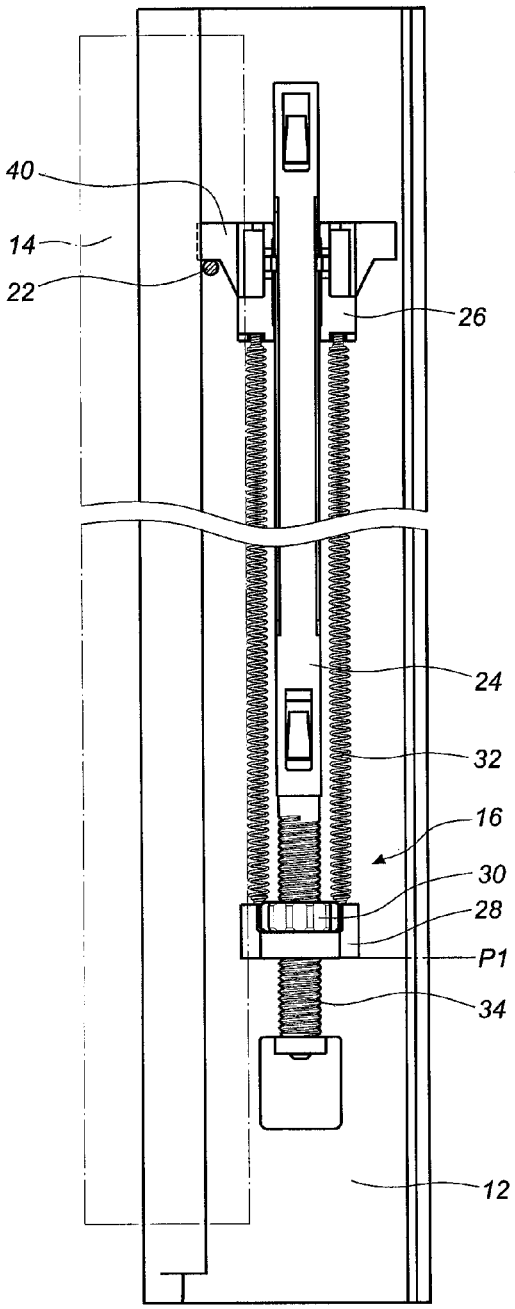
FIG. 3 shows that the adjustment frame of the elastic force adjustment device of the present invention is located at the first position.

FIG. 3 shows the second rail 14 is retracted relative to the first rail 12 and the push member 22 on the second rail 14 contacts the contact portion 40 of the movable member 26 of the elastic force adjustment device 16. The movable member 26 moves a pre-set distance along the longitudinal guiding portion 38 of the fixing member 24, so that the at least one elastic member 32 of the adjustment frame 28 and the movable member 26 are pulled so as to store an elastic force relative to the second rail 14. In this status, an engaging device (not shown) is connected between the first and second rails 12, 14 to position the second rail 14, relative to the retracted first rail 12 by the engaging device. In other words, the movable member 26 applied by the at least one elastic member 32 cannot push the second rail 14 via the push member 22. The adjustment frame 28 is moved by the adjustment member 30 and is set at the first position P1 on the threaded rod 34 of the fixing member 24.

Figure 4:
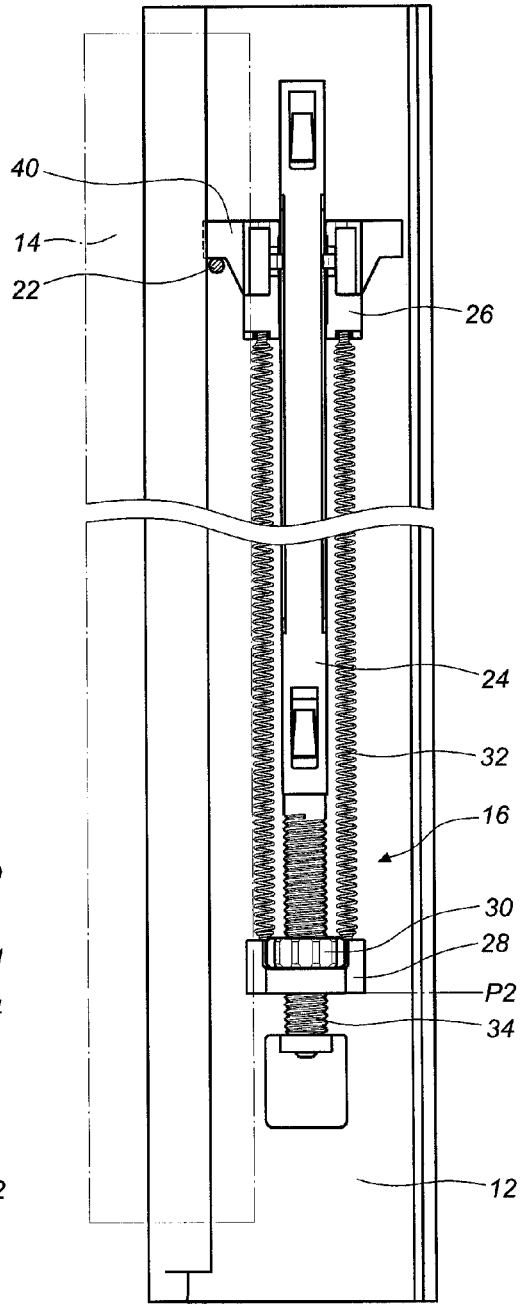
FIG. 4 shows that the adjustment frame of the elastic force adjustment device of the present invention is adjusted and located at the second position.

FIG. 4 shows that the adjustment member 30 of the elastic force adjustment device 16 is rotated on the threaded rod 34 of the fixing member 24 to contact and move the adjustment frame 28 from the first position P1 on the threaded rod 34 of the fixing member 24 to the second position P2, and the adjustment frame 28 is positioned at the second position P2. In this status, the relative distance between the movable member 26 and the adjustment frame 28 is adjusted, and the status of the at least one elastic member 32 of the adjustment frame 28 and the movable member 26 are adjusted. This is to say, the stored elastic force is adjusted.

Therefore, when the second rail 14 is retracted relative to the first rail 12 to extend the at least one elastic member 32 by the contact of the push member 22 and the contact portion 40 of the movable member 26, the movable member 26 applies the stored elastic force to the second rail 14, wherein the stored elastic force is formed according to the extension of the at least one elastic member 32. The elastic force from the at least one elastic member 32 is released and then applies to the contact portion 40 of the movable member 26 and moves the push member 22 of the second rail 14 so that the second rail 14 is opened to a desired position relative to the first rail 12.

Figure 5:
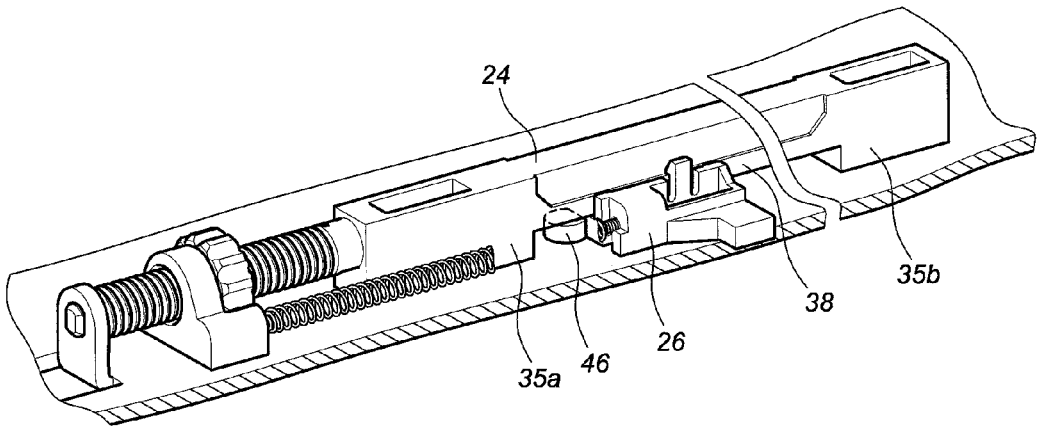
FIG. 5 shows that the fixing member includes a stop.
Figure 6:
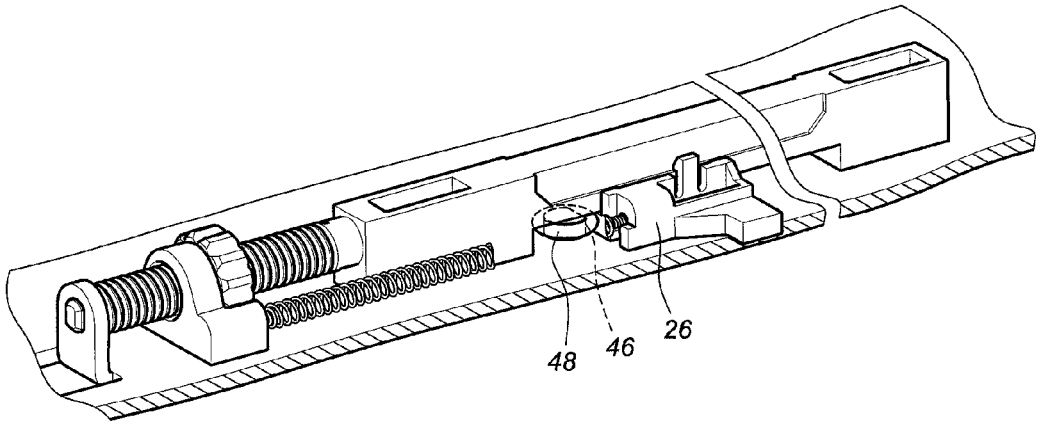
FIG. 6 shows that the stop is mounted by a buffering coat.

Furthermore, as shown in FIG. 5, considering that the movable member 26 is pulled by the at least one elastic member 32 and moves along the longitudinal guiding portion 38 of the fixing member 24. The fixing member 24 has a stop 46 located between the first and second ends 35*a*, 35*b* thereof. In this embodiment, the stop 46 is located close to the first end 35*a*, and the movable member 26 is movable between the second end 35*b* of the fixing member 24 and the stop 46. As shown in FIG. 6, a buffering coat 48 is mounted to the stop 46 so as to reduce the noise when the movable member 26 contacts the stop 46.

Figure 7:
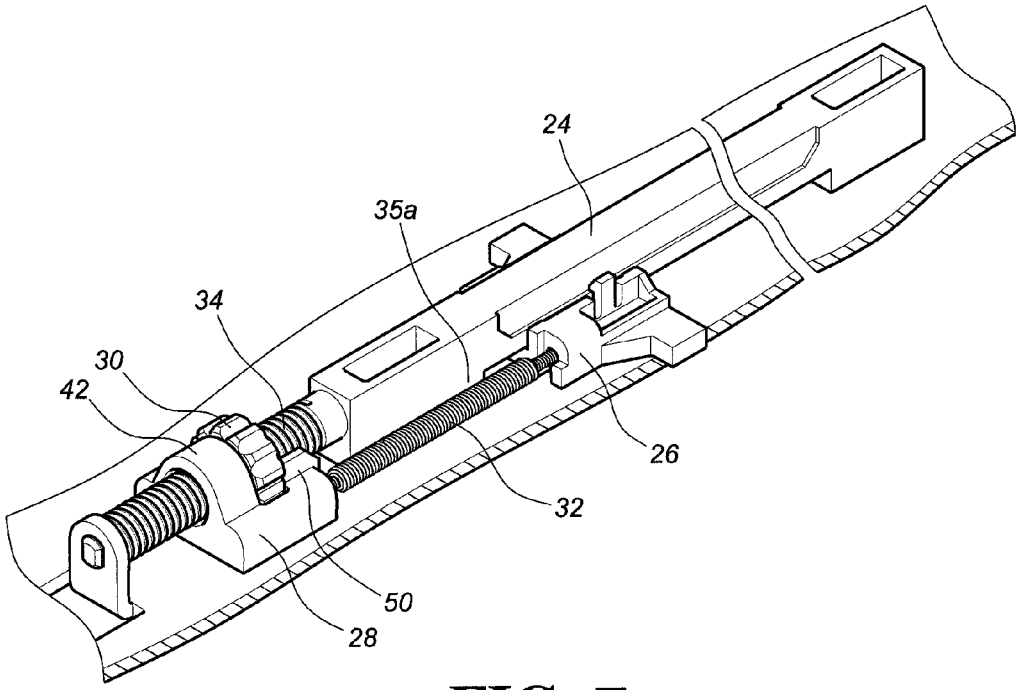
FIG. 7 shows the position of the movable member when the elastic member is in compressed status.

In another situation, as shown in FIG. 7, the stop position of the movable member 26 applied by the elastic force of the at least one elastic member 32 can be controlled by the compressed length of the at least one elastic member 32. The adjustment member 30 and the adjustment frame 28 are adjusted to a third position on the threaded rod 34 of the fixing member 24. The third position allows the movable member 26 not to contact the first end 35*a* of the longitudinal guiding portion 38 of the fixing member 24 or the stop 46. The adjustment frame 28 further includes an urging member 50 wherein the adjustment member 30 is located and in contact between the urging member 50 and the mounting portion 42. By this arrangement, the adjustment member 30 and the adjustment frame 28 are moved back and forth together.

The elastic force adjustment device for slide assembly allows the users to adjust the elastic force as needed. Especially when drawers are installed to the slide assembly and different weights of objects are received in the drawers, by the adjustment of the elastic force, the elastic force of each drawer can be properly adjusted so that the drawers can be opened to a desired position for convenience of accessing the objects in the drawers when the drawers are operated under the push-open mode.

While we have shown and described the embodiment in accordance with the present invention, it should be clear to those skilled in the art that further embodiments may be made without departing from the scope of the present invention.

What is claimed is:

1. An elastic force adjustment device for slide assembly which includes a first rail and a second rail slidably connected to the first rail, the elastic force adjustment device comprising:

a fixing member adapted to be fixedly connected to the first rail and including a threaded rod and a longitudinal body, the longitudinal body having a first end and a second end which is located opposite to the first end, and a longitudinal guiding portion located between the first and second ends;

a movable member slidably connected to the longitudinal guiding portion of the fixing member, the movable member being displaced responsive to displacement of the second rail;

an adjustment frame having a mounting portion connected to the threaded rod of the fixing member;

at least one elastic member having two ends respectively connected to the movable member and the adjustment frame; and an adjustment member having a threaded portion threadedly connected to the threaded rod of the fixing member, the adjustment member contacts the adjustment frame and is rotatable in a first direction to displace the adjustment frame relative to the movable member for adjusting a return force of the at least one elastic member.

2. The device as claimed in claim 1, wherein the fixing member has a stop located between the first and second ends thereof, the movable member is movable between the second end of the fixing member and the stop.

3. The device as claimed in claim 2, further comprising a buffering coat mounted to the stop.

4. The device as claimed in claim 1, wherein the second rail includes a push member located in correspondence with the movable member and being in contact therewith.

5. The device as claimed in claim 1, comprising a pair of elastic members, each respectively coupled on opposing ends thereof to the movable member and the adjustment frame.

6. The device as claimed in claim 5, wherein the pair of elastic members are respectively disposed on opposing sides of the fixing member.

7. The device as claimed in claim 1, wherein the adjustment member is rotatable in a second direction for compressing the at least one elastic member to function as a stop for limiting displacement of the movable member in one direction.

* * * * *